United States Patent [19]

McDonald

[11] 3,952,694

[45] Apr. 27, 1976

[54] MARINE SIGNALLING DEVICE

[76] Inventor: Ean Lawrence McDonald, 48 Ord St., West Perth, Australia

[22] Filed: Nov. 15, 1974

[21] Appl. No.: 524,278

Related U.S. Application Data

[63] Continuation-in-part of Ser. No. 384,421, Aug. 1, 1973, abandoned.

[30] Foreign Application Priority Data

Aug. 4, 1972 Australia ..... 58668/73

[52] U.S. Cl. ..... 116/124 B; 114/209

[51] Int. Cl.[2] ..... B63B 45/00

[58] Field of Search ..... 114/209; 116/124 B, 116/114 R; 9/8 R, 9, 11 A, 13

[56] References Cited

UNITED STATES PATENTS

| | | | |
|---|---|---|---|
| 137,190 | 3/1873 | Fleetwood | 114/209 |
| 1,927,124 | 9/1933 | Jones | 9/11 A |
| 2,342,773 | 2/1944 | Wellman | 9/13 |
| 2,639,106 | 5/1953 | Sesera | 116/124 B |
| 2,715,231 | 8/1955 | Marston | 9/11 A |
| 2,816,299 | 12/1957 | Holladay | 9/13 |
| 3,002,490 | 10/1961 | Murray | 116/DIG. 9 |
| 3,164,801 | 1/1965 | Nicholl | 116/124 B |
| 3,334,554 | 8/1967 | Adams | 116/35 R |
| 3,378,864 | 4/1968 | Cornes | 9/11 A |
| 3,417,725 | 12/1968 | Fisher | 114/209 |
| 3,540,063 | 11/1970 | Stanwood | 9/8 R |
| 3,727,229 | 4/1973 | Clinger | 343/706 |

FOREIGN PATENTS OR APPLICATIONS

| | | | |
|---|---|---|---|
| 651,692 | 11/1962 | Canada | 116/124 B |

*Primary Examiner*—S. Clement Swisher
*Assistant Examiner*—Denis E. Corr
*Attorney, Agent, or Firm*—Haseltine, Lake & Waters

[57] ABSTRACT

A signalling device for indicating the position of a boat or person in the water comprising a bouyant member adapted to be attached to the boat or person and being of a color contrasting with that of the sea, characterized in that the buoyant member is formed of a length of plastic sheeting which has a specific gravity of less than 1 and which is capable of being rolled or folded to occupy a small space for storage or transport, and in that the free end thereof is provided with means such as a sea anchor so that when in use it will stream away from the boat or person.

13 Claims, 12 Drawing Figures

MARINE SIGNALLING DEVICE

CROSS-RELATED APPLICATIONS

This application is a continuation-in-part of application Ser. No. 384,421 filed Aug. 1, 1973, and claiming the priority of Australian application No. PA9965/72 filed Aug. 4, 1972.

FIELD OF THE INVENTION

The invention relates to an improved signalling device and in particular a distress signalling device for use with watercraft.

BACKGROUND

Boats or persons who are lost at sea are often difficult to locate by searching aircraft or boats. There are presently available for signalling by boats at sea to search aircraft and/or other boats, transient signalling devices such as flares, smoke floats, dye markers and the like. However the problem with such signalling means is their transience, their susceptability to damage causing their failure, the necessity for regular maintenance and their relative difficulty in use.

SUMMARY OF THE INVENTION

It is an object of this invention to provide a signalling device to be used as a distress signal wherein the device provides its signalling characteristics for as long as desired with little checking required. In addition it is a further object to provide a signalling device which is completely self-contained requires no other mechanical, electrical or the like adjuncts, requires no maintenance to insure it is operational is cheap to produce and light in weight.

Accordingly the invention resides in a signalling device for indicating the position of a boat or person in the water comprising a bouyant member adapted to be attached to the boat or person and being of a color contrasting with that of the sea, characterized in that the bouyant member is formed of a length of plastic sheeting which has a specific gravity of less than 1 which is capable of being rolled or folded to occupy a small space for storage or transport, and in that the free end thereof is provided with a drag means so that when in use it will unroll or unfold and stream away from the boat or person by remaining up wind from said boat or person.

BRIEF DESCRIPTION OF THE DRAWINGS

The invention will be more fully understood in the light of the following description of one specific embodiment. The description is made with reference to the accompanying drawings of which.

DETAILED DESCRIPTION OF THE DRAWING

Figure 1A:
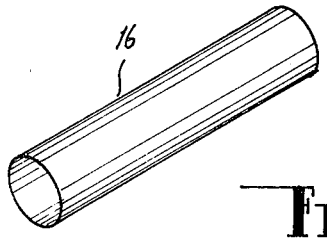
FIGS. 1A, 1B and 1C illustrate a signalling device according to the embodiment in various stages of assembly.
Figure 1B:
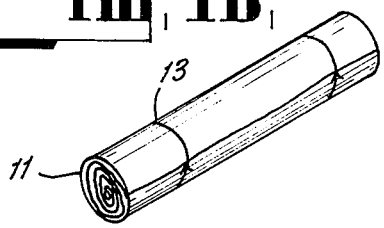
Figure 1C:
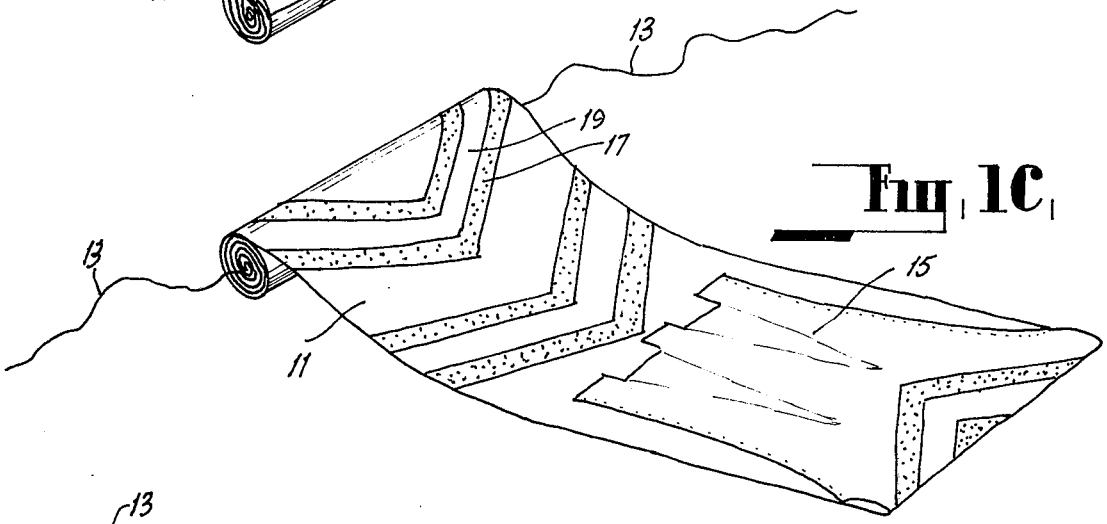
Figure 2A:
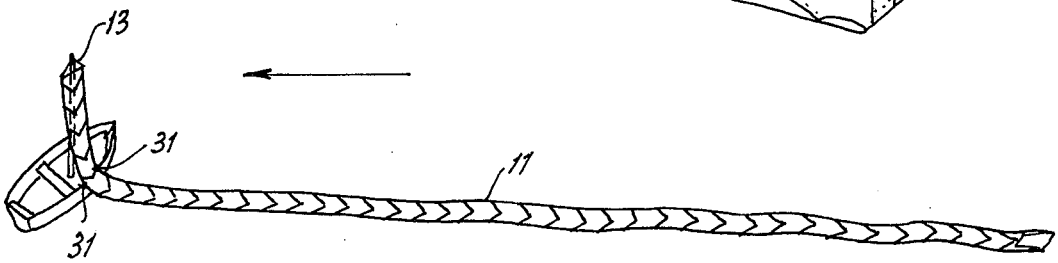
FIGS. 2A, 2B and 2C illustrate the signalling device of the embodiment in use with a small dinghy, sailing boat or person (the arrows indicating the prevailing wind direction)
Figure 2B:
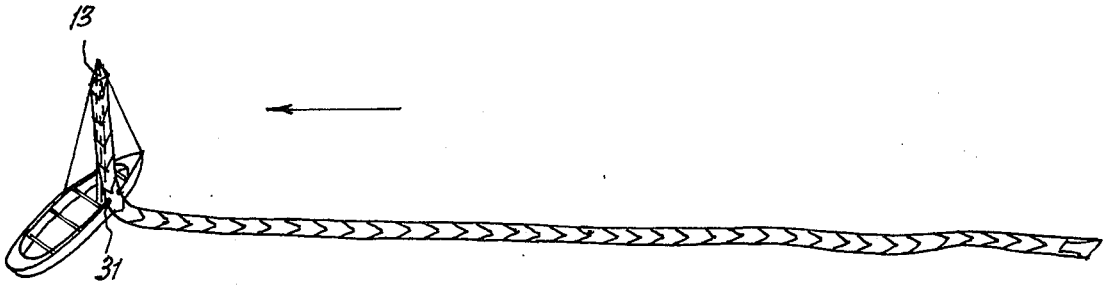
Figure 2C:
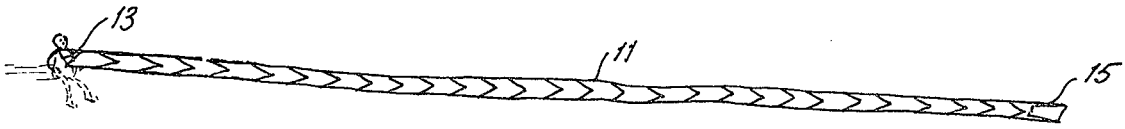
Figure 3:
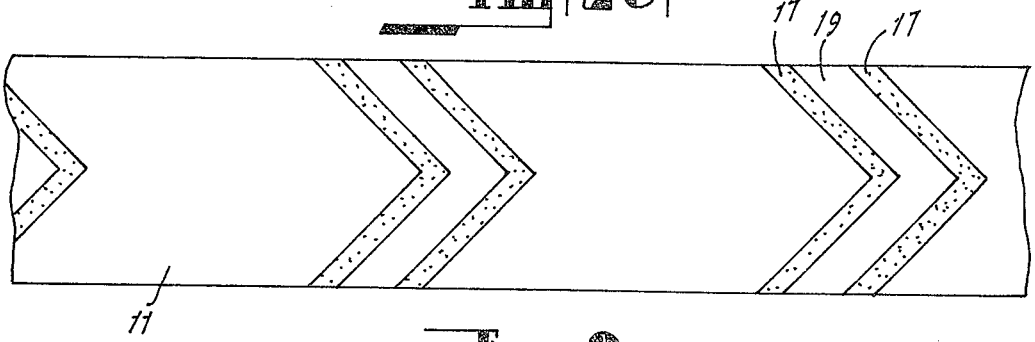
FIG. 3 is a plan view of a portion of the signalling device of the embodiment illustrating the signalling patterns thereon.

The embodiment as shown in the accompanying drawings comprises a plastic sheet 11 having securing lines 13 attached at one end and drag means 15 at the other. A storage envelope or container 16 is used to contain the signalling device for both packaging and protective purposes. The securing lines 13 may be used for packaging the device for storage purposes as seen in FIG. 1B and for securing the device to the boat or person as seen in FIGS. 2A, 2B and 2C. The plastic sheeting forming the signalling portion of the device is formed from a material having a specific gravity of less than 1 such as woven polyproplene in order that it will be self-supported upon water. According to this embodiment the main portion of the sheet is colored orange and has black V's 19 imprinted on the sheet to both sides thereof. The black V on an orange background being an international distress signal. V-shaped markers of aluminum 17 or other suitable material may be formed into the sheet or mounted or printed on the sheeting in association with the black V's in order to provide light and/or radar reflectivity to further enhance the possibility of being detected by searchers.

Figure 5A:
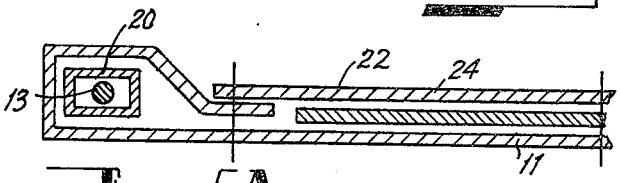
FIGS. 5A and 5B are respectively a cross-sectional and a perspective view of the securing end portion of the signalling device of the embodiment.
Figure 5B:
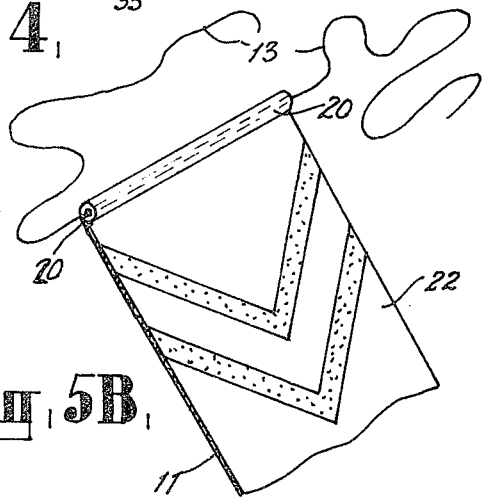
Figure 6A:
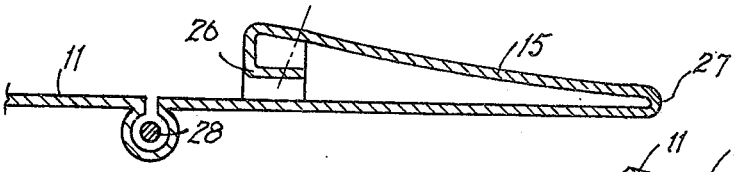
FIGS. 6A and 6B are respectively a perspective and cross-sectional view of the drag means of the signalling device according to the embodiment, FIG. 6A being a cross-section taken along a line perpendicular to the center of rod 28.
Figure 6B:
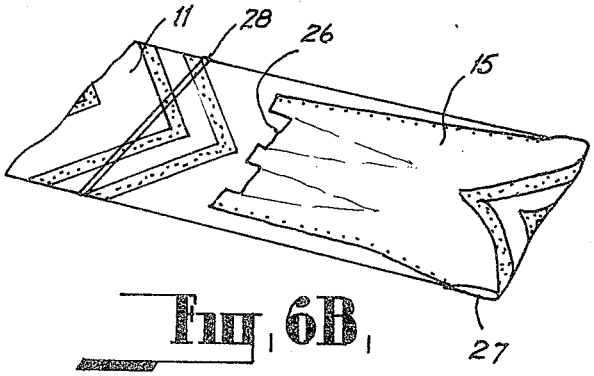

The securing lines are mounted to the signalling device in the manner shown in FIGS. 5A and 5B. A tubular member 20 is incorporated in the end of the device by folding over the end of the plastic material over and around the tubular member and bonding or fixing the free end to the plastic sheet. The tubular member 20 is of square cross-section to prevent rotation of the member within its mounting in the turned over end portion. Securing lines 13 are passed through the tubular member.

A portion of the plastic sheeting adjacent the mounting for the securing lines has another piece of plastic sheeting 22 fixed to it. A radar reflecting material such as aluminum 24 is positioned between two of the plastic sheets 11 and 22.

The free end of the signalling device has drag means 15 formed therein. The drag means is formed by turning over the end portion of the plastic sheeting and attaching it along both sides thereof to the main body of the sheeting. The end edge of the plastic sheeting is not attached to the main body of the sheeting to form an open mouth 26 to the drag means. In attaching the sides of the end portion it is insured that the width of the open mouth 26 to the drag means is narrower than the width of the sheeting. Such a construction insures that the mouth of the sea anchor is maintained open when in use. Openings 27 in the end of the drag means permits the escape of water contained by it. A rod shaped member 28 is mounted transversely on the plastic sheet adjacent the open mouth. The purpose of the member 28 is to weight the drag means end of the signalling device and maintain the plastic sheeting at its full width in the region of the sea anchor to insure proper operation of the drag means.

Figure 4:
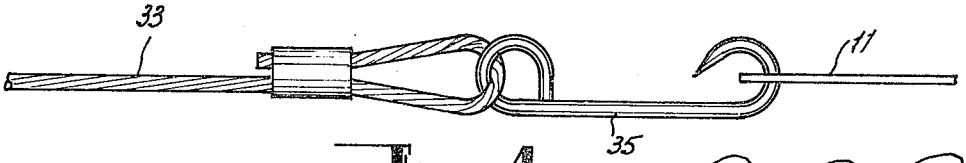
FIG. 4 illustrates the means of fixing the signalling device of the embodiment to the gunwale or to the hull of the boat.

When required for use the securing lines 13 are attached to the boat or body of the person in the water and the drag means portion 15 of the device is dropped into the water and the device is permitted to be fed out. Alternatively, if placed in a rolled or folded state in the water with the drag means outermost, the device will unroll or unfold itself because of the drag means remaining upwind from the boat or person. In order to increase the possibilities of detection a vertical component may be incorporated into the signalling device by fixing the securing lines to the top of the mast of the boat if in existence or the highest portion of the boats superstructure or to the end of an oar which is positioned vertically in the boat. The upper portion of the signalling device is prevented from streaming out to take on a partially horizontal position by fixing the plastic sheet a short distance from the securing end to the gunwale or portion of the boats hull adjacent the waterline as shown in FIGS. 2A and 2B at 31. FIG. 4 illustrates one securing means for attaching the sheeting to a portion of the boats hull. The securing means comprises a securing line 33 having a loop formed at both ends and a hook member 35 mounted in the loop. The hook being engaged into the edge of the plastic sheet in holes formed therein. The holes may be reinforced with suitable rivetting means. As a result of this mounting the signalling device has both a horizontal signal component for aircraft in close proximity and a vertical signal component for other boats or aircraft some distance away. The use of the radar reflecting material 24 incorporated in the securing end portion of the device forming the vertical component insures that the device will reflect radar and so increasing the possibility of detection by searching aircraft and/or shipping. The use of radar reflective V-shaped aluminum markers 17 increases the possibility of detection by searching aircraft and/or shipping. The V-shaped aluminum markers 17 provide a high light reflectivity to the signalling device to assist in both night or day searching.

I claim:

1. A signalling device for indicating the position of a boat in the water comprising a buoyant member adapted to be attached to the boat and being of a color contrasting with that of the sea, the buoyant member being of a length of sheeting which has a specific gravity of less than one and which is rolled or folded to occupy a small space for storage or transport and is adapted to unroll or unfold in the water, drag means, said sheeting including a free end and an end adapted to be attached to the boat, said drag means being operatively associated with said free end so that when in use will unroll or unfold and stream from the boat by remaining upwind from the boat, the length of said sheeting substantially greater than that of said boat.

2. A signalling device as claimed in claim 1 wherein the signalling device has suitable distress signalling devices incorporated in the plastic sheeting a portion of which are formed of radar reflective material.

3. A signalling device as claimed in claim 1 wherein the plastic sheeting is formed from woven polypropylene.

4. A signalling device as claimed in claim 1 wherein the signalling also comprises a tubular member of a square cross-section which is non-rotatably mounted onto the end of the length of the sheeting adapted to be attached to the boat and means for attaching the tubular member to the said sheeting being of a plastic having a specific gravity of less than one.

5. A signalling device as claimed in claim 4 wherein said means for attaching the tubular member to the boat comprises a securing rope which passes axially through said tubular member and which is adapted for attaching the signalling device to the boat.

6. A signalling device as claimed in claim 1 wherein the drag means comprises a folded free end portion of the sheeting defining a mouth, the sides of the folded portion being attached to the body of the sheeting such that the lines of attachment run along the edge of the sides of the folded portion and converge towards the end of the folded portion and such that the width of the mouth of the drag means is narrower than the width of the sheeting, so ensuring the mouth is maintained open, and a weight secured to the sheeting adjacent the drag means.

7. A signalling device for indicating the position of a person in the water comprising a buoyant member adapted to be attached to the body of the person and being of a color contrasting with that of the sea, the buoyant member being of a length of sheeting is rolled or folded to occupy a small space for storage and transport and is adapted to unroll or unfold in the water, drag means, said plastic sheeting including a free end and an end adapted to be attached to the person, said drag means being operatively associated with said free end so that when in use the sheeting will unroll or unfold and stream from the person by remaining upwind from the person, the length of said sheeting being substantially greater than that of said person.

8. A signalling device as claimed in claim 7 wherein the signalling device also comprises a tubular member of a square cross-section which is non-rotatably mounted onto the end of the length of the sheeting adapted to be attached to the person and means for attaching the tubular member to the person.

9. A signalling device as claimed in claim 8 wherein said means for attaching the tubular member to the boat comprises a securing rope which passes axially through said tubular member and which is adapted for attaching the signalling device to the person.

10. A signalling device as claimed in claim 7 wherein the drag means comprises a folded free end portion of the sheeting defining a mouth, the sides of the folded portion being attached to the body of the sheeting such that the lines of attachment run along the edge of the sides of the folded portion and converge towards the end of the folded portion and such that the width of the mouth of the drag means is narrower than the width of the sheeting, so ensuring the mouth is maintained open, and a weight secured to the sheeting adjacent the drag means.

11. A signalling device for indicating the position of a boat in the water, said boat including an upper and a lower portion thereto, comprising a buoyant member adapted to be attached to the boat and being of a color contrasting with that of the sea, the buoyant member being a length of plastic sheeting including a free end and which has a specific gravity of less than 1 and which is adapted for being rolled or folded to occupy a small space for storage or transport, drag means being operatively associated with said free end so that when in use the device will unroll or unfold and stream away from the boat by remaining upwind from the boat, and the signalling device being adapted for being mounted upon the upper portion of the boat, said signalling device including means for displaying a signal spaced from the portion mounted to the upper portion of the boat, to be attached to the lower portion of the boat so that the length of the signalling device between points of attachment to the upper and lower portions of the boat provides a vertical signal component to the device.

12. A signalling device as claimed in claim 11 wherein the signalling device also comprises a tubular member of a square cross-section which is non-rotatably mounted in the end of the length of the plastic sheeting adapted to be attached to the boat and means for attaching the tubular member to the boat.

13. A signalling device as claimed in claim 11 wherein the drag means comprises a folded free end portion of the sheeting defining a mouth, the sides of the folded portion being attached to the body of the sheeting such that the lines of attachment run along the edge of the sides of the folded portion and converge towards the end of the folded portion and such that the width of the mouth of the drag means is narrower than the width of the sheeting, so ensuring the mouth is maintained open, and a weight secured to the sheeting adjacent the drag means.

* * * * *